United States Patent [19]

Drakeley

[11] Patent Number: 4,756,229

[45] Date of Patent: Jul. 12, 1988

[54] DIGITAL MOTOR FEEDBACK FOR A POSITION ACTUATOR

[75] Inventor: George M. Drakeley, Suffield, Conn.

[73] Assignee: United Technologies Corporation, Hartford, Conn.

[21] Appl. No.: 911,564

[22] Filed: Sep. 25, 1986

[51] Int. Cl.[4] ..... F01B 25/26; F01B 31/12

[52] U.S. Cl. ..... 91/1; 92/5 R; 73/1 D; 91/361

[58] Field of Search ..... 91/1, 361, DIG. 4; 92/5; 73/1 D, 865.9; 408/16; 33/172 E, 60

[56] References Cited

U.S. PATENT DOCUMENTS

| | | | |
|---|---|---|---|
| 2,914,756 | 11/1959 | Heidenhain et al. | 324/208 X |
| 3,281,825 | 10/1966 | Corl et al. | 324/208 X |
| 4,471,304 | 9/1984 | Wolf | 92/5 R X |

FOREIGN PATENT DOCUMENTS

| | | | |
|---|---|---|---|
| 124727 | 11/1984 | European Pat. Off. | 5 R/ |
| 2348066 | 3/1975 | Fed. Rep. of Germany | 92/5 R |
| 3139638 | 4/1983 | Fed. Rep. of Germany | 92/5 R |
| 2056692 | 3/1981 | United Kingdom | 92/5 R |

*Primary Examiner*—Robert A. Garrett
*Assistant Examiner*—Mark A. Williamson
*Attorney, Agent, or Firm*—Dominic J. Chiantera

[57] ABSTRACT

A linear actuator (42) includes a housing (44), and a linearly displaceable piston (46) having a shaft (48) with a gradated position scale (60) and a gradated direction scale (62) disposed by ion implantation on a casing (50) of the shaft, in axial alignment (49) with the shaft stroke. Proximity sensors (64, 66) mounted in the housing sense movement in the position of the scales to provide sensed shaft position signals (68) and sense shaft direction signals (70).

6 Claims, 4 Drawing Sheets

DIGITAL MOTOR FEEDBACK FOR A POSITION ACTUATOR

DESCRIPTION

1. Technical Field

This invention relates to linear actuators, and more particularly to sensing piston displacement therein.

2. Background Art

As known, closed loop control of linear actuators requires accurate sensed position feedback signals. In prior art actuators the position feedback signals are analog, and are produced by a potentiometer or a variable differential transformer which is geared to the actuator piston. The differential transformers may include either linear variable differential transformers (LVDT) or rotary variable differential transformers (RVDT). However, LVDT devices are most popular for high accuracy applications.

LVDT sensors are both cumbersome and expensive, and incorporating them into an actuator involves a high degree of complexity. The LVDTs are mounted within the actuator piston and, therefore, define the piston's dimensions, which generally exceeds the sizes otherwise required for mechanical strength. The piston, and the entire actuator, could otherwise be made smaller. In addition, the LVDT mounting requires extensive machining of the supporting parts within the actuator. Although the RVDT and potentiometer devices are mounted external of the actuator and, therefore, do not impact actuator geometry to the same extent, they are similarly complex and costly.

Furthermore, when the actuator is used in a system providing a flight critical function, such as controlling air inlet position for a gas turbine engine, or for fuel metering control within a gas turbine engine, the feedback sensors must be duplicated to provide redundant sensing and increased reliability. This is at the expense of doubling the complexity and cost of signal sensor configurations.

3. Disclosure of Invention

The object of the present invention is to provide a method and apparatus for sensing position and slew direction of a linear actuator, using a digital signal format.

According to the present invention, a linear actuator comprises a housing and a piston which is movable through the housing, over a stroke range directed along a displacement axis, the piston includes a shaft having a graduated position scale and a graduated slew direction scale disposed therealong in axial alignment with the displacement axis, the scale gradations comprising ion implanted material, the actuator further comprising proximity sensing devices associated with each scale, each sensor located in the trajectory of its associated scale for providing a pulse signal whenever a scale gradation passes in proximity to the sensor, whereby the pulse signals provide indications of piston position and slew direction.

In further accord with the present invention, the gradations of the position scale are at fixed intervals, defining equal piston stroke increments, and the slew direction scale gradations are spaced at increasing distances from one end of the scale to the opposite end of the scale, so as to allow sensed discrimination between the piston slew direction.

The linear actuator of the present invention provides a digital signal indication of actuator position and slew direction. The motion of the piston is detected by passage of the ion implanted scale gradations under the proximity sensors. The sensors provide a pulsed signal output which can be pulse counted to determine actual position, and also frequency counted to provide an indication of slew direction.

The elimination of analog feedback signal devices, such as variable differential transformers or potentiometers, results in greater noise immunity, and integrity of the feedback signal. These and other objects, features and advantages of the present invention will become more apparent in light of the following detailed description of a best mode embodiment thereof, as illustrated in the accompanying Drawing.

BEST MODE FOR CARRYING OUT THE INVENTION

Figure 4:
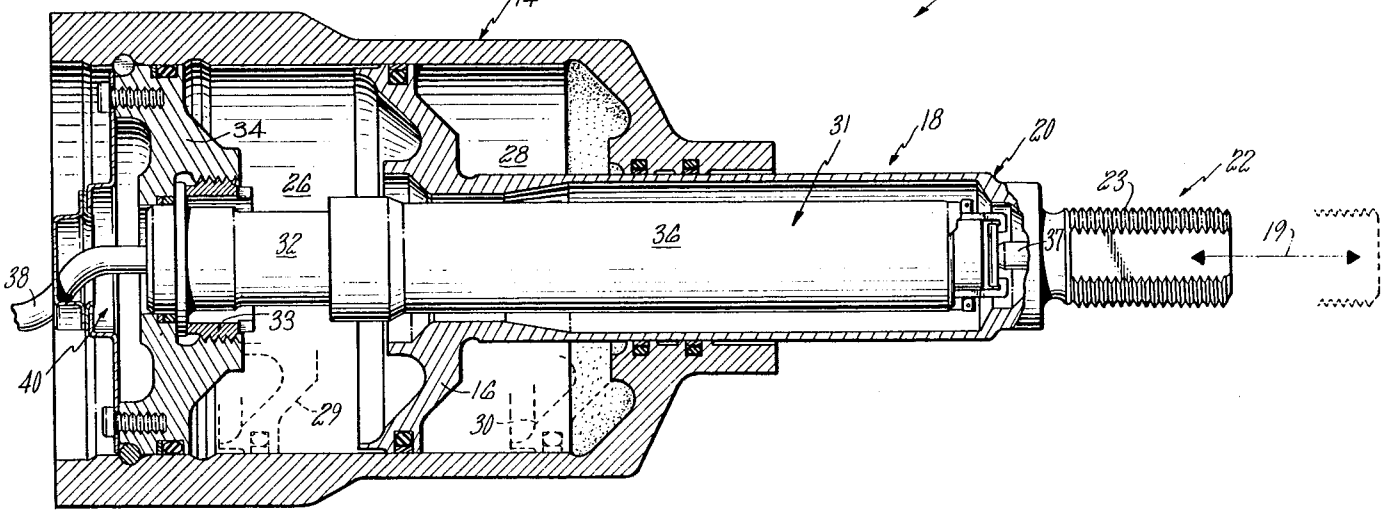
FIG. 4 PRIOR ART
FIG. 4 is a cross sectioned illustration of a linear stroke actuator according to the prior art.

Referring first to FIG. 4, in a cross sectioned illustration of a prior art linear actuator 12, the actuator includes a barrel assembly 14, and a piston assembly 16 which is housed within the barrel and having a hollow shaft 18 adapted for reciprocal linear motion along a displacement axis 19. The shaft includes a casing 20 having a load connector assembly 22 at the other end. The load connector, which is shown as having a threaded surface 23, is adapted for connection to an actuator load, such as an aircraft's stator vane assemlby, engine fuel valve, etc.

As known, in the fluidic actuator of FIG. 4, displacement is due to the differential pressure across the piston 16; between the internal chambers 26, 28. The piston is in a quiescent position when the differential pressure across the piston is at equilibrium. The actual pressure difference is controlled by controlling the fluid delivery and fluid discharge (i.e. fluid pressure) in chambers 26, 28, as provided through fluid orifices (not shown) in the barrel.

The piston stroke extends from a fully retracted position, phantom piston position 29, to a fully extended position, as shown by phantom piston position 30. Information on the piston's sensed position is provided by a linear variable differential transformer (LVDT) 31, mounted within the piston shaft 18. The LVDT is a known type such as the LVDT Model 2640XS-1923 LVDT manufactured by Schaevitz Engineering Company, Pennsauken, N.J. The LVDT is a telescoping device, with a fixed section 32 mounted through a threaded connection 33 to an anvil 34, and a movable section 36. The anvil is secured within the barrel by a shear ring positioned in a groove formed by the barrel and the anvil. The movable section 36 is connected to the piston load connector assembly 22 through a link and socket assembly 37.

The movable section 36 travels in unison with piston stroke. This causes movement of the LVDT magnetic core, changing the magnetic inductance between the LVDT primary and dual secondary windings, and producing an output signal as the differential voltage between two secondary windings. The output signal is provided on lines 38 through the back plate 40 of the barrel housing.

To satisfy avionic equipment reliability requirements the LVDT is a dual redundant device. It has duplicate core and winding assemblies within the LVDT housing. The dual redundant configuration causes the devices to be cumbersome. Incorporating them into the actuator assembly is costly, since they require a large envelope and extensive machining of supporting parts for installations within the piston assembly. They are also susceptible to failure in a vibration environment.

Figure 1:
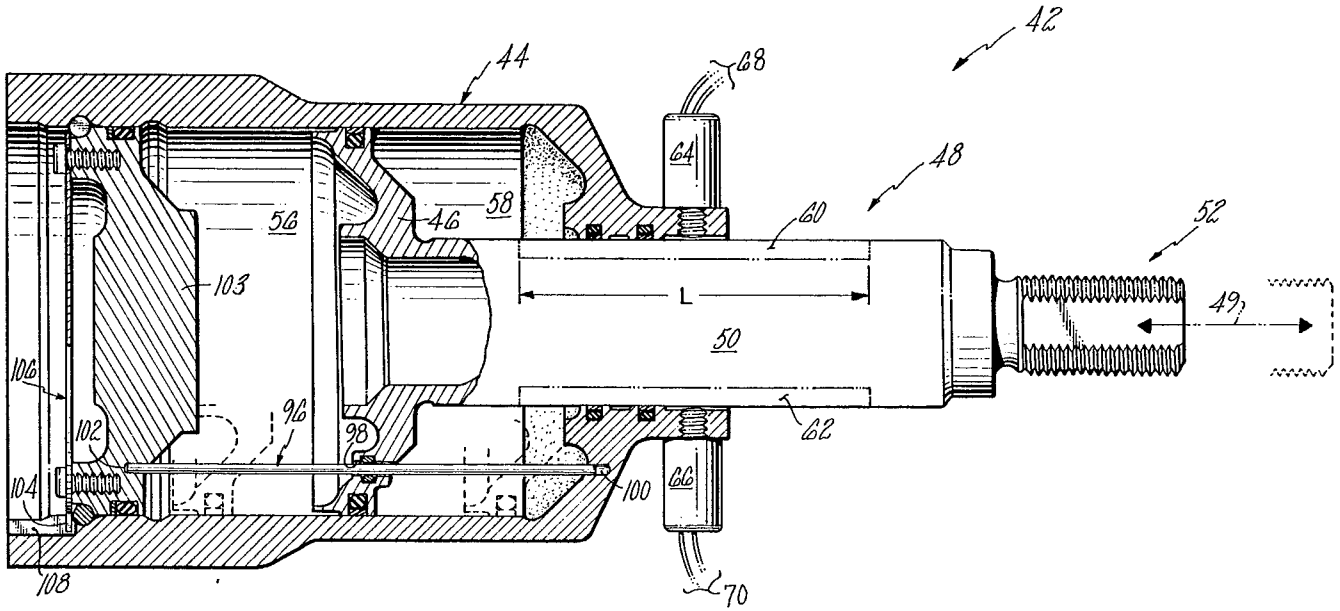
FIG. 1 is a cross sectioned illustration of a best mode embodiment of a linear stroke actuator according to the present invention.

Referring now to FIG. 1, which illustrtes in cross section a linear actuator 42 according to the present invention. The actuator includes a barrel housing 44, and a piston assembly 46 having a hollow shaft 48 adapted to linearly extend and retract along a displacement axis 49. The shaft includes a casing 50 with a load connector assembly 52 on the outer end. As with the prior art actuator of FIG. 4, shaft displacement is determined by the differential pressure across the piston 46, between internal chambers 56, 58 of the barrel.

Thus far the description of the present actuator 42 is similar to that of the prior art actuator of FIG. 4. The point of departure of the present actuator from that of prior art linear actuators is in the sensing of piston position. In the present actuator, piston position and the direction of piston travel (extend/retract) is provided by graduated scales deposited on the piston shaft casing 50. A position scale 60 and a slew direction scale 62 are disposed in axial alignment with displacement axis 48, on the piston casing. The coordinate location of the scales on the casing perimeter may be selected to suit a desired application. In a best mode embodiment, the position and slew direction scales are located on proximate opposite sides of the piston casing, i.e. nominal 180 degree spacing. This allows for the optional placement of a second set of scales, i.e. redundant scales, at a proximate 90 degree spacing from the primary scale's locations.

The scales 60, 62 are disposed along a length L of the piston shaft; a distance which is at least as long as the piston stroke range. The scale gradations, as described in detail in FIG. 2 for the position scale 60 and in FIG. 3 for the slew direction scale 62, comprise ion implanted material. Proximity sensors 64, 66 are mounted on the end of the barrel housing, in proximity to the piston shaft, and in the trajectory of the position scale and slew direction scale, respectively. The sensors are a known type, such as P/N 6251800 manufactured by C&A Transducer Inc., Garden Grove, Calif. The signal output from the sensors 64, 66 are produced on output lines 68, 70.

Figure 2:
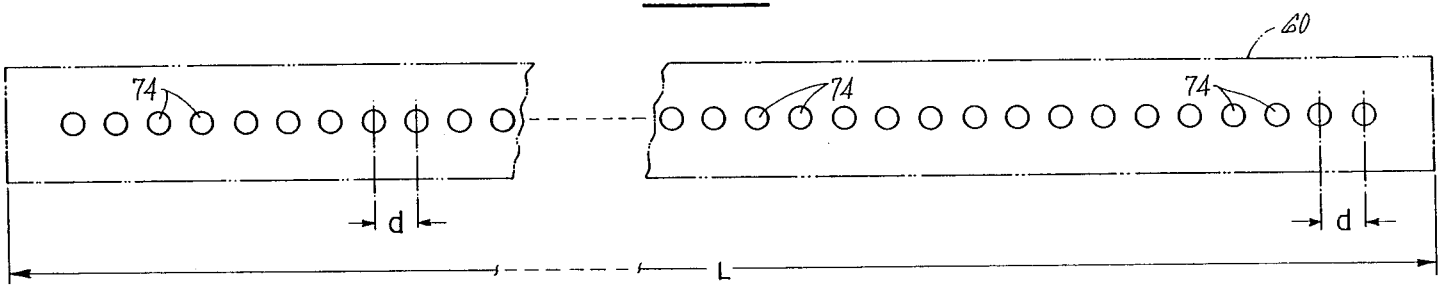
FIG. 2 is a plan illustration of one element of the embodiment of FIG. 1.

Referring now to FIG. 2, which illustrates the gradated position scale 60. In a best mode embodiment, the scale includes a plurality of ion implanted dots 74, disposed at a center-to-center stroke spacing (d) along the length L of the scale. The dots comprise a detectable material such as cobalt or nickel, which are disposed on the piston shaft casing by known ion implantation techniques. The deposited ion implanted dots change the magnetic properties of the shaft casing material, which itself may comprise stainless steel AMS 5737. This produces a "relative" change in the magnetic properties of the shaft casing in the proximity of the dot locations, which are then sensed by the proximity sensors 64, 66 to provide the sensed position signal and sensed direction signal indications on the lines 68, 70. Radioactive material may also be implanted on the piston shaft. This technique would require an appropriate type of sensor.

As known, ion implantation introduces impurities into the near surface region of solid materials, by directing a beam of ions at the solid's surface. The ions penetrate the surface material and come to rest within the near surface region. An ion source provides the ion stream through plasma discharge. As the ions are extracted from the plasma and accelerated through a high voltage acceleration field (typically 10,000 to 500,000 volts), they are passed through a variable transverse magnetic field, which allows a lateral sweeping of the beam along the length L of the scale. A precision template having the desired dot pattern geometry is masked onto the casing surface, thereby allowing the implantation to occur only in the defined dot areas. The region between the ion source and the masked piston shaft casing is maintained under vacuum to prevent beam attenuation.

The advantages of the implantation process includes precise control of the type of impurity to be introduced into the solid, the amount of impurity introduced, and the depth of the impurity distribution. The use of templates allows precise geometric definition of the piston shaft area to be exposed to the ion beam, thereby allowing precise control over the geometric pattern of the scale. By integrating the current flow of the beam, the total ion charge is obtained (using the known charge per ion), such that the number of ions implanted in the source target can be precisely controlled.

The number of dots (N) and the maximum center-to-center spacing (d) between dots is determined by the sensed position resolution requirements for the particular application. A typical stroke range, i.e. length L, is from two to three inches. For a two inch stroke, a 0.020 inch center-to-center spacing of the dots provides a 1% scale resolution. This requires 100 dot implants, each at a nominal diameter of 0.010 inch.

Figure 5:
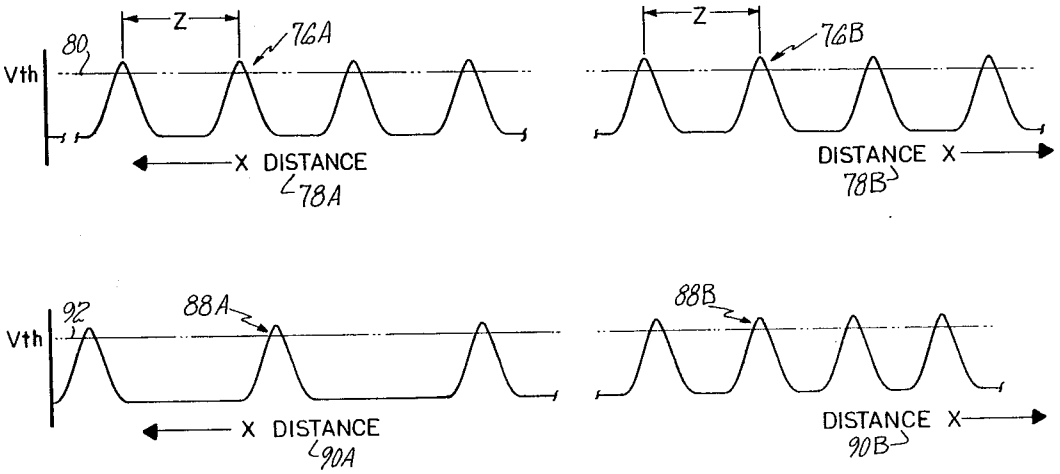
FIGS. 5*a* and 5*b* are illustrations of a set of signal waveforms used in the description of the embodiment of FIG. 1.

FIG. 5, illustration (a) shows the sensed position signal output on lines 68 from the sensor 64, under a slewing condition of the actuator. The illustration is on a split X axis, showing a waveform 76A for a retracting slew direction 78A and a waveform 76B for the extension slew direction 78B. The sensed signal waveforms are signal conditioned, through known techniques, which compare the waveform peak amplitudes to a threshold $V_{Th}$ 80. Peak amplitudes which exceed the threshold are converted into a pulse.

Figure 6:
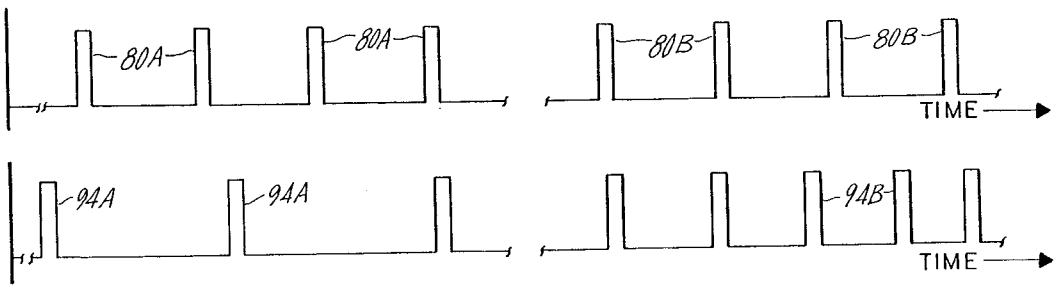
FIGS. 6*a* and 6*b* are illustrations of an alternative format for the waveform illustration of FIG. 5.

FIG. 6, illustration (a) shows a series of pulses 80A, 80B which, for the purposes of this description, are assumed to be derived from the waveforms 76A, 76B. Each pulse marks a gradation (d) on the position scale, and when integrated over time, provides a sensed piston position feedback signal.

Figure 3:
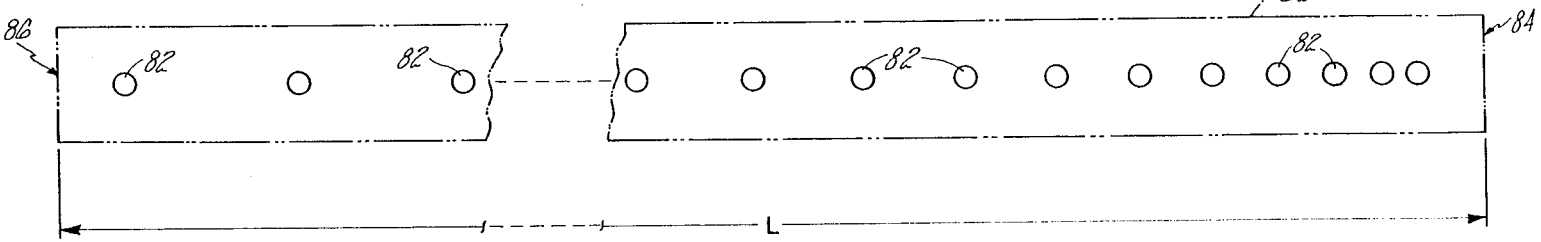
FIG. 3 is a plan illustration of another element of the embodiment of FIG. 1.

FIG. 3 illustrates the slew direction scale 62. The direction scale similarly includes a plurality of implanted ion dots 82, but located on a variable gradated scale, as opposed to the fixed gradations of the position scale 60. In the direction scale the center-to-center spacing of the dots implanted towards a first end 84 of the scale is smaller in dimension than that of the dots implanted toward a second end 86 of the scale. The first and second ends may correspond to either the fully extended or fully retracted positions of the actuator.

The spacing of the dots 82 increases incrementally, from the first end 84 to the second end 86. The greater or lesser spacing between the sensed pulse output from the direction sensor 66 distinguishes the piston slew direction, from a first direction (e.g. extend) to a second direction (e.g. retract). The actual change in spacing is selectable; depending on the sensed accuracy requirements. In FIG. 3, the spacing (S) is shown to increase linearly, from a space $S_1$ to $S_1+\Delta$ to $S_1+2\Delta$ etc. However, the manner in which the spacing is graduated is not limited to any one progression, but may be selected by those skilled in the art, as may be necessary for a particular application.

The dots 82 are implanted in the same manner as the position scale dots 74, but using a different geometry template for the scale gradations. FIG. 5, illustration (b) shows the sensed pulse output from the sensor 66 for two different slew directions. Waveform 88A corresponds to X direction 90A and waveform 88B is associated with direction 90B. As shown, the peak to peak spacing of the waveforms differ; the spacing of waveform 88A increasing with X distance 90A and that of waveform 88B decreasing with increasing X distance 90B.

The waveforms 88A, 88B may be processed in a similar manner as the position scale waveforms 76A, 76B. The peak amplitudes are compared against a reference threshold voltage 92 (FIG. 5) to provide a conditioned pulse equivalent signal, as shown with the pulsed signal of FIG. 6(*b*). The pulses 94A, 94B correspond to the sensed direction waveforms 88A, 88B (FIG. 5(*b*)). When the pulses 94A, 94B are plotted against time (t), the waveform 94A has a lower frequency and the waveform 94B has a higher frequency.

As stated hereinbefore, by comparing the sensed position pulsed signals 80A, 80B (FIG. 6(*a*)) with the sensed direction pulsed signals 94A, 94B, the slew direction may be determined. Sensed direction pulsed signal frequencies which are lower than the sensed position frequency indicate one slew direction, and those that are higher indicate another slew direction.

Referring again to FIG. 1, antirotation rod 96 provides alignment of the trajectory of the scales 60, 62 with the sensors 64, 66 during piston travel. The rod is inserted through a hole 98 in the piston 46 into a bore 100 in the barrel housing. The hole 98 includes an O-ring pressure seal to prevent fluid leakage between the chambers 56, 58. The opposite end of the rod is located in a second bore 102 in the anvil assembly 103. The two bores fix the rod in position. To prevent displacement of the anvil due to ballistic forces on the piston during slew, a key 104 is inserted in the barrel housing cover 106. The key is fixed in position by a key-slot 108 in the barrel housing.

The linear actuator of the present invention provides both sensed piston position information, and slew direction, in a digital signal format. This format, comprising pulsed signal formation, leads itself to digital signal processing techniques and ease of information manipulation by the parent control system. Furthermore, the signal format provides improved noise immunity and simplification of hardware requirements over that provided, or required, by analog formatted approaches.

It should be understood by those skilled in the art that the use of ion implanted positions and slew direction scales on the piston shaft casing is not limited to hydraulic type actuators. Any other type of linear actuator, including electric or pneumatic, may similarly incorporate the casing scales.

Although the present invention has been shown and described with respect to a best mode embodiment thereof, it should be understood by those skilled in the art, that various other changes, additions, and deletions may be made therein, without departing from the spirit and scope of the invention.

I claim:

1. An actuator for linearly positioning a load device along a displacement axis in response to position control signals received thereby, and for providing signal indications of the load device position and direction of travel, comprising:

a shaft, aligned with the displacement axis and connected at one end to a piston and adapted at the other end for connection to the load device, said shaft including a casing with a position scale and a direction scale disposed thereon, each said scale comprising ion implanted gradations, said position scale gradations spaced at equal stroke range intervals along a position scale trajectory and said direction scale gradations spaced at nonequal stroke range intervals along a direction scale trajectory; and housing means, including motive means connected to said piston for moving said shaft along the displacement axis in response to the position control signal, said housing means further including sensor means disposed each in the path of each said position scale trajectory and the path of said direction scale trajectory, for sensing passage of the associated scale gradations thereby with movement of said shaft to provide the signal indications of load device position and direction of travel, respectively.

2. The actuator of claim 1, wherein said housing further includes means for aligning said position scale trajectory with said position sensor means and for aligning said direction scale trajectory with said direction sensor means.

3. The actuator of claim 1, wherein said casing comprises stainless steel and said ion implanted gradations comprise cobalt material.

4. The actuator of claim 3, wherein said stainless steel comprises AMS 5737.

5. The actuator of claim 1, wherein said casing comprises stainless steel and said ion implanted gradations comprise nickel material.

6. The actuator of claim 5, wherein said stainless steel comprises AMS 5737.

* * * * *

UNITED STATES PATENT AND TRADEMARK OFFICE

CERTIFICATE OF CORRECTION

PATENT NO. : 4,756,229

DATED : July 12, 1988

INVENTOR(S) : George M. Drakeley

It is certified that error appears in the above-identified patent and that said Letters Patent is hereby corrected as shown below:

In the title, "Motor" should read --Motion--

Column 1, line 50, "graduated" should read --gradated--

Column 3, line 20, "illustrtes" should read --illustrates--

Column 5, line 61, "leads" should read --lends--

Signed and Sealed this

Twenty-eighth Day of August, 1990

*Attest:*

HARRY F. MANBECK, JR.

*Attesting Officer*

*Commissioner of Patents and Trademarks*